US006260450B1

(12) United States Patent
Ragsdale, Jr. et al.

(10) Patent No.: US 6,260,450 B1
(45) Date of Patent: Jul. 17, 2001

(54) WRENCH SOCKET DEVICE

(76) Inventors: Billy L. Ragsdale, Jr.; Angela M. Ragsdale, both of 401 Heyward Ave., Honea Path, SC (US) 29654

( * ) Notice: Subject to any disclaimer, the term of this patent is extended or adjusted under 35 U.S.C. 154(b) by 0 days.

(21) Appl. No.: 09/470,759

(22) Filed: Dec. 23, 1999

(51) Int. Cl.[7] ..... B25B 13/06
(52) U.S. Cl. ..... 81/121.1; 81/63; D8/29
(58) Field of Search ..... 81/121.1, 124.6, 81/63, 124.4; D8/29

(56) References Cited

U.S. PATENT DOCUMENTS

D. 272,468 * 1/1984 Bulgarelli et al. ..... D8/29
D. 275,443 * 9/1984 Snaper ..... D8/29
D. 303,342 * 9/1989 Katz ..... D8/29
D. 342,001 * 12/1993 Hibbert ..... D8/29
2,138,331 * 11/1938 Ward ..... 81/63
5,862,721 * 1/1999 Kowats ..... 81/121.1

* cited by examiner

*Primary Examiner*—Eileen P. Morgan
*Assistant Examiner*—Joni B. Danganan

(57) ABSTRACT

A wrench socket device for fitting the contours of the nut handles of the pipe clamps. The wrench socket device includes a gripping member having a hollow interior, a tubular upper portion and an enlarged lower portion which has an ovoid breadth which includes a pair of opposed end walls which are parallel to one another and a pair of opposed curved side walls which are curved toward one another, the gripping member further having an open bottom which has an ovoid shape which includes a pair of opposed end edges which are parallel to one another and a pair of opposed curved side edges which are curved toward one another, and further includes a wrench member having a handle member and a shaft extending therefrom and being attachable to the tubular upper portion of the gripping member. The wrench member may also include a ratchet mechanism which includes a tooth wheel and a pawl disposed in an end of the handle member.

2 Claims, 2 Drawing Sheets

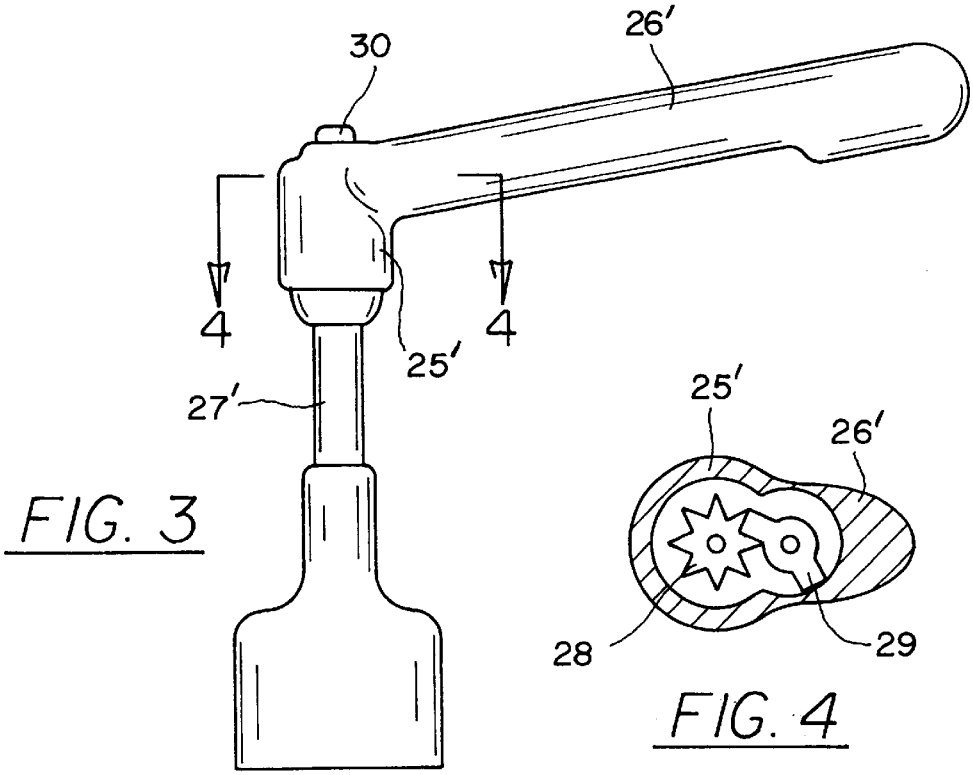
FIG. 3
FIG. 4
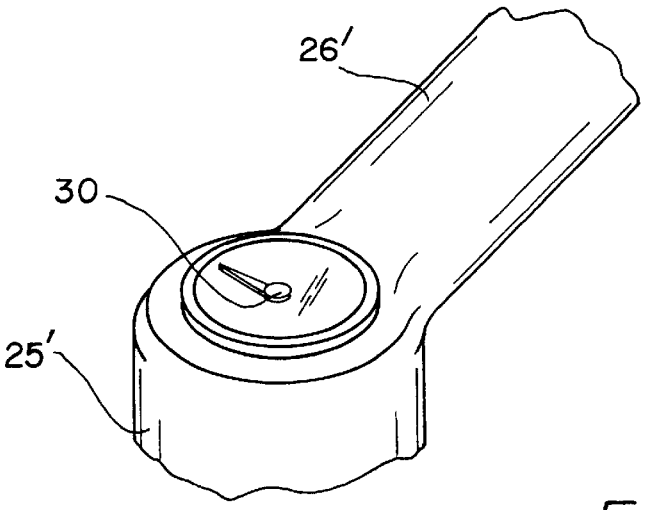
FIG. 5

WRENCH SOCKET DEVICE

BACKGROUND OF THE INVENTION

1. Field of the Invention

The present invention relates to a pipe clamp wrench and more particularly pertains to a new wrench socket device for fitting the contours of the nut handles of the pipe clamps.

2. Description of the Prior Art

The use of pipe clamp wrenches is known in the prior art. More specifically, pipe clamp wrench heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,054,179; U.S. Pat. No. 1,371,933; U.S. Pat. No. 4,336,637; U.S. Pat. No. 4,520,697; U.S. Pat. No. 5,000,066; and U.S. Pat. No. Des. 335,616.

While these devices fulfill their respective, particular objectives and requirements, the aforementioned patents do not disclose a new wrench socket device. The inventive device includes a gripping member having a hollow interior, a tubular upper portion and an enlarged lower portion which has an ovoid breadth which includes a pair of opposed end walls which are parallel to one another and a pair of opposed curved side walls which are curved toward one another, the gripping member further having an open bottom which has an ovoid shape which includes a pair of opposed end edges which are parallel to one another and a pair of opposed curved side edges which are curved toward one another, and further includes a wrench member having a handle member and a shaft extending therefrom and being attachable to the tubular upper portion of the gripping member. The wrench member may also include a ratchet mechanism which includes a tooth wheel and a pawl disposed in an end of the handle member.

In these respects, the wrench socket device according to the present invention substantially departs from the conventional concepts and designs of the prior art, and in so doing provides an apparatus primarily developed for the purpose of fitting the contours of the nut handles of the pipe clamps.

SUMMARY OF THE INVENTION

In view of the foregoing disadvantages inherent in the known types of pipe clamp wrench now present in the prior art, the present invention provides a new wrench socket device construction wherein the same can be utilized for fitting the contours of the nut handles of the pipe clamps.

The general purpose of the present invention, which will be described subsequently in greater detail, is to provide a new wrench socket device which has many of the advantages of the pipe clamp wrench mentioned heretofore and many novel features that result in a new wrench socket device which is not anticipated, rendered obvious, suggested, or even implied by any of the prior art pipe clamp wrench, either alone or in any combination thereof.

To attain this, the present invention generally comprises a gripping member having a hollow interior, a tubular upper portion and an enlarged lower portion which has an ovoid breath which includes a pair of opposed end walls which are parallel to one another and a pair of opposed curved side walls which are curved toward one another, the gripping member further having an open bottom which has an ovoid shape which includes a pair of opposed end edges which are parallel to one another and a pair of opposed curved side edges which are curved toward one another, and further includes a wrench member having a handle member and a shaft extending therefrom and being attachable to the tubular upper portion of the gripping member. The wrench member may also include a ratchet mechanism which includes a tooth wheel and a pawl disposed in an end of the handle member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wrench socket device which has many of the advantages of the pipe clamp wrench mentioned heretofore and many novel features that result in a new wrench socket device which is not anticipated, rendered obvious, suggested, or even implied by any of the prior art pipe clamp wrench, either alone or in any combination thereof.

It is another object of the present invention to provide a new wrench socket device which may be easily and efficiently manufactured and marketed.

It is a further object of the present invention to provide a new wrench socket device which is of a durable and reliable construction.

An even further object of the present invention is to provide a new wrench socket device which is susceptible of a low cost of manufacture with regard to both materials and labor, and which accordingly is then susceptible of low prices of sale to the consuming public, thereby making such wrench socket device economically available to the buying public.

Still yet another object of the present invention is to provide a new wrench socket device which provides in the apparatuses and methods of the prior art some of the advantages thereof, while simultaneously overcoming some of the disadvantages normally associated therewith.

Still another object of the present invention is to provide a new wrench socket device for fitting the contours of the nut handles of the pipe clamps.

Yet another object of the present invention is to provide a new wrench socket device which includes a gripping member having a hollow interior, a tubular upper portion and an enlarged lower portion which has an ovoid breadth which includes a pair of opposed end walls which are parallel to one another and a pair of opposed curved side walls which are curved toward one another, the gripping member further having an open bottom which has an ovoid shape which includes a pair of opposed end edges which are parallel to one another and a pair of opposed curved side edges which are curved toward one another, and further includes a wrench member having a handle member and a shaft extending therefrom and being attachable to the tubular upper portion of the gripping member. The wrench member may also include a ratchet mechanism which includes a tooth wheel and a pawl disposed in an end of the handle member.

Still yet another object of the present invention is to provide a new wrench socket device that effectively reduces the amount of time and effort to install and remove pipe clamps.

Even still another object of the present invention is to provide a new wrench socket device that is convenient and easy to use and carry.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevational view of the present invention including a ratcheting wrench member.

FIG. 4 is a detailed view of the tooth wheel and the pawl of the ratcheting wrench of the present invention.

FIG. 5 is a detailed perspective view of the ratcheting wrench of the present invention.

DESCRIPTION OF THE PREFERRED EMBODIMENT

Figure 1:
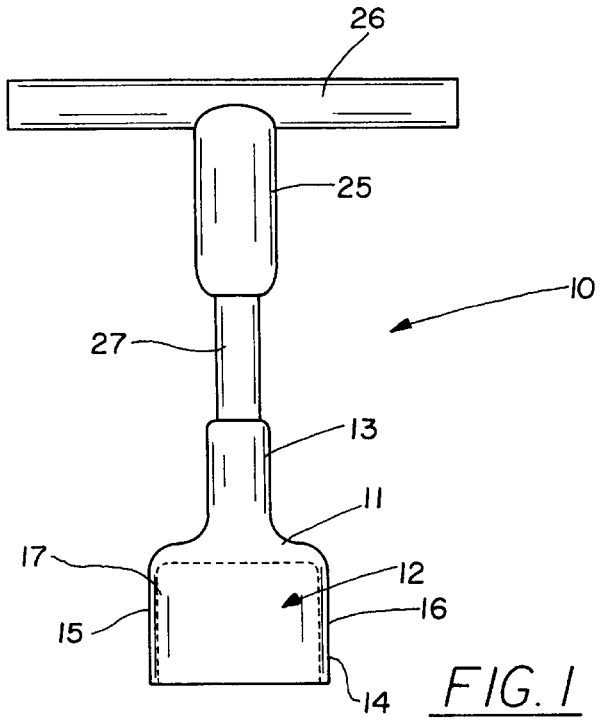
FIG. 1 is a side elevational view of a new wrench socket device according to the present invention.
Figure 2:
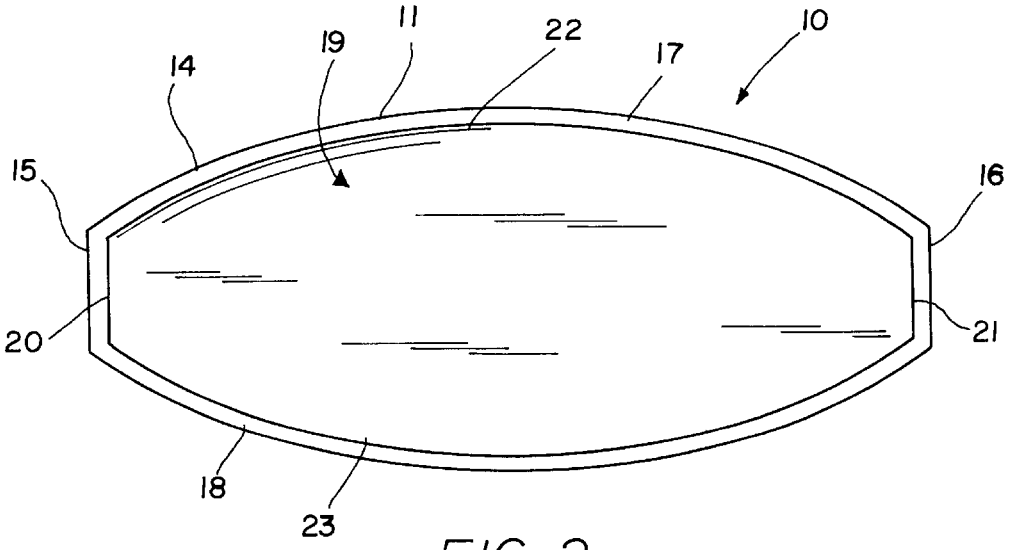
FIG. 2 is a bottom plan view of the present invention.

With reference now to the drawings, and in particular to FIGS. 1 through 5 thereof, a new wrench socket device embodying the principles and concepts of the present invention and generally designated by the reference numeral 10 will be described.

As best illustrated in FIGS. 1 through 5, the wrench socket device 10 generally comprises a gripping member 11 having a tubular upper portion 13, an enlarged lower portion 14 having a hollow interior 12 for receiving fastening members, and an open bottom 19. The enlarged portion 14 has an ovoid breadth with opposed end walls 15,16. The end walls 15,16 are parallel to one another. The enlarged portion 14 also has a pair of opposed curved side walls 17,18 which are curved toward one another. The open bottom 19 has an ovoid shape with opposed end edges 20,21 which are parallel to one another, and with curved side edges 22,23 which are curved toward one another. The open bottom 19 being approximately 1⅜ inches long and ⅝ inches wide. A wrench member 25 is removeably attachable to the top end of the tubular upper portion 13 of the gripping member 11. The wrench member 25 includes a handle member 26 and shaft 27 extending from the handle member 26. As a second embodiment, the wrench member 25' includes a ratchet mechanism having a tooth wheel 28 and a pawl 29 disposed in an end of the handle member 26' for rotating the gripping member 11, and further having a control member 30 connected to the pawl 29 for maneuvering and setting the pawl 29 about the tooth wheel 28.

In use, the gripping member 11 is placed over and about a fastening member and with the wrench member 25, the user turns the handle member 26 which in turn, turns the gripping member 11 which in turn, turns the fastening member to either tighten or loosen the fastening member which are essentially nuts on pipe clamps.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A wrench socket device comprising:

a gripping member having a tubular upper portion, an enlarged lower portion having a hollow interior, and an open bottom said enlarged portion having an ovoid breadth with opposed end walls, said end walls being parallel to one another, said enlarged portion leaving a pair of opposed curved side walls which are curved toward one another, said side walls having a length greater than a length of said end walls, said open bottom having an ovoid shape with opposed end edges, said end edges being parallel to one another, and with curved side edges which are curved toward one another, said side edges having a length greater than a length of said end edges, said open bottom being approximately 1⅜ inches long and ⅝ inches wide; and a wrench member being removeably attachable to said tubular upper portion of said gripping member, said wrench member including a handle member and shaft extending from said handle member to said gripping member.

2. A wrench socket device as described in claim 1, wherein said wrench member includes a ratchet mechanism having a tooth wheel and a pawl disposed in an end of said handle member for rotating said gripping member, and further having a control member disposed in said end of said handle member for maneuvering the pawl about the tooth wheel.

* * * * *